US006298487B1

(12) United States Patent
Mayhew

(10) Patent No.: US 6,298,487 B1
(45) Date of Patent: Oct. 9, 2001

(54) SURVIVAL ARTICLE OF CLOTHING

(76) Inventor: James W. Mayhew, 29 Peel Street, London (GB), W8 7PA ( * ) Notice: Subject to any disclaimer, the term of this patent is extended or adjusted under 35 U.S.C. 154(b) by 0 days.

(21) Appl. No.: 09/662,200

(22) Filed: Sep. 15, 2000

(51) Int. Cl.[7] ..... A41D 1/02
(52) U.S. Cl. ..... 2/108; 2/69; 2/DIG. 3
(58) Field of Search ..... 2/456, 463–465, 2/2.11, 2.14, 468, 60, 252, 69, 69.5, 92, 102, 108, 126, DIG. 3; 441/87, 88, 102, 94, 106, 108

(56) References Cited

U.S. PATENT DOCUMENTS

| | | | | |
|---|---|---|---|---|
| D. 399,335 | | 10/1998 | Sarni, Jr. . | |
| 4,097,947 | * | 7/1978 | Kiefer | 9/338 |
| 4,246,672 | * | 1/1981 | Fujiyama et al. | 9/321 |
| 4,365,628 | | 12/1982 | Hodel . | |
| 4,637,074 | * | 1/1987 | Taheri | 2/456 |
| 4,767,371 | | 8/1988 | Jackson . | |
| 4,943,252 | | 7/1990 | Manix . | |
| 4,977,623 | * | 12/1990 | DeMarco | 2/69 |
| 5,490,501 | | 2/1996 | Crowley . | |
| 5,500,952 | * | 3/1996 | Keyes | 2/456 |
| 5,718,000 | * | 2/1998 | Ost et al. | 2/69 |
| 5,781,936 | | 7/1998 | Alaloof . | |
| 5,815,833 | * | 10/1998 | Kuo | 2/69.5 |

* cited by examiner

*Primary Examiner*—John J. Calvert
*Assistant Examiner*—Tejash Patel

(57) ABSTRACT

A survival article of clothing for preventing suffocation or being crushed by the user until help can arrive. The survival article of clothing includes a sleeve-less inflatable jacket member having a neck opening, shoulder portions, arm openings through the shoulder portions thereof, and being adapted to cover a front and a back of a user's upper torso with the jacket member also having an expandable outer layer of material and an inner layer of material and a collar member securely attached along the neck opening for covering the user's neck region; and also includes a front and back foldable flap-like protective members being securely attached along the neck opening of said jacket member and being adapted to extend about the user's face below one's eyes and about a lower portion of the user's back of one's head; and further includes strap members being fastenable to a bottom portion of the jacket member and being extendable about the user's legs; and also includes sleeve members being removably attached to about the arm openings of the jacket member; and further includes an inflation assembly for inflating the jacket member and providing oxygen to the user.

16 Claims, 5 Drawing Sheets

SURVIVAL ARTICLE OF CLOTHING

BACKGROUND OF THE INVENTION

1. Field of the Invention

The present invention relates to a survival jacket and more particularly pertains to a new survival article of clothing for preventing suffocation or being crushed by the user until help can arrive.

2. Description of the Prior Art

The use of a survival jacket is known in the prior art. More specifically, a survival jacket heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,490,501; U.S. Pat. No. 4,365,628; U.S. Pat. No. 5,781,936; U.S. Pat. No. 4,767,371; U.S. Pat. No. Des. 399,335; and U.S. Pat. No. 4,943,252.

While these devices fulfill their respective, particular objectives and requirements, the aforementioned patents do not disclose a new survival article of clothing. The inventive device includes a sleeve-less inflatable jacket member having a neck opening, shoulder portions, arm openings through the shoulder portions thereof, and being adapted to cover a front and a back of a user's upper torso with the jacket member also having an expandable outer layer of material and an inner layer of material and a collar member securely attached along the neck opening for covering the user's neck region; and also includes a front and back foldable flap-like protective members being securely attached along the neck opening of said jacket member and being adapted to extend about the user's face below one's eyes and about a lower portion of the user's back of one's head; and further includes strap members being fastenable to a bottom portion of the jacket member and being extendable about the user's legs; and also includes sleeve members being removably attached to about the arm openings of the jacket member; and further includes an inflation assembly for inflating the jacket member and providing oxygen to the user.

A survival article of clothing as described in claim 1, wherein said outer layer of material includes first and second pleated portions along said front side and said back side of said jacket member, each of said first and second pleated portions extending from said neck opening to a bottom of said jacket member along a central portion of a respective said front and back sides of said jacket member.

In these respects, the survival article of clothing according to the present invention substantially departs from the conventional concepts and designs of the prior art, and in so doing provides an apparatus primarily developed for the purpose of preventing suffocation or being crushed by the user until help can arrive.

SUMMARY OF THE INVENTION

In view of the foregoing disadvantages inherent in the known types of survival jacket now present in the prior art, the present invention provides a new survival article of clothing construction wherein the same can be utilized for preventing suffocation or being crushed by the user until help can arrive.

The general purpose of the present invention, which will be described subsequently in greater detail, is to provide a new survival article of clothing which has many of the advantages of the survival jacket mentioned heretofore and many novel features that result in a new survival article of clothing which is not anticipated, rendered obvious, suggested, or even implied by any of the prior art survival jacket, either alone or in any combination thereof.

To attain this, the present invention generally comprises a sleeve-less inflatable jacket member having a neck opening, shoulder portions, arm openings through the shoulder portions thereof, and being adapted to cover a front and a back of a user's upper torso with the jacket member also having an expandable outer layer of material and an inner layer of material and a collar member securely attached along the neck opening for covering the user's neck region; and also includes a front and back foldable flap-like protective members being securely attached along the neck opening of said jacket member and being adapted to extend about the user's face below one's eyes and about a lower portion of the user's back of one's head; and further includes strap members being fastenable to a bottom portion of the jacket member and being extendable about the user's legs; and also includes sleeve members being removably attached to about the arm openings of the jacket member; and further includes an inflation assembly for inflating the jacket member and providing oxygen to the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new survival article of clothing which has many of the advantages of the survival jacket mentioned heretofore and many novel features that result in a new survival article of clothing which is not anticipated, rendered obvious, suggested, or even implied by any of the prior art survival jacket, either alone or in any combination thereof.

It is another object of the present invention to provide a new survival article of clothing which may be easily and efficiently manufactured and marketed.

It is a further object of the present invention to provide a new survival article of clothing which is of a durable and reliable construction.

An even further object of the present invention is to provide a new survival article of clothing which is susceptible of a low cost of manufacture with regard to both materials and labor, and which accordingly is then susceptible of low prices of sale to the consuming public, thereby making such survival article of clothing economically available to the buying public.

Still yet another object of the present invention is to provide a new survival article of clothing which provides in the apparatuses and methods of the prior art some of the advantages thereof, while simultaneously overcoming some of the disadvantages normally associated therewith.

Still another object of the present invention is to provide a new survival article of clothing for preventing suffocation or being crushed by the user until help can arrive.

Yet another object of the present invention is to provide a new survival article of clothing which includes a sleeve-less inflatable jacket member having a neck opening, shoulder portions, arm openings through the shoulder portions thereof, and being adapted to cover a front and a back of a user's upper torso with the jacket member also having an expandable outer layer of material and an inner layer of material and a collar member securely attached along the neck opening for covering the user's neck region; and also includes a front and back foldable flap-like protective members being securely attached along the neck opening of said jacket member and being adapted to extend about the user's face below one's eyes and about a lower portion of the user's back of one's head; and further includes strap members being fastenable to a bottom portion of the jacket member and being extendable about the user's legs; and also includes sleeve members being removably attached to about the arm openings of the jacket member; and further includes an inflation assembly for inflating the jacket member and providing oxygen to the user.

Still yet another object of the present invention is to provide a new survival article of clothing that is easy and convenient to understand and use by anybody and does not interfere with the one's activities such as snow skiing.

Even still another object of the present invention is to provide a new survival article of clothing that can effectively save the lives of a person trapped.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
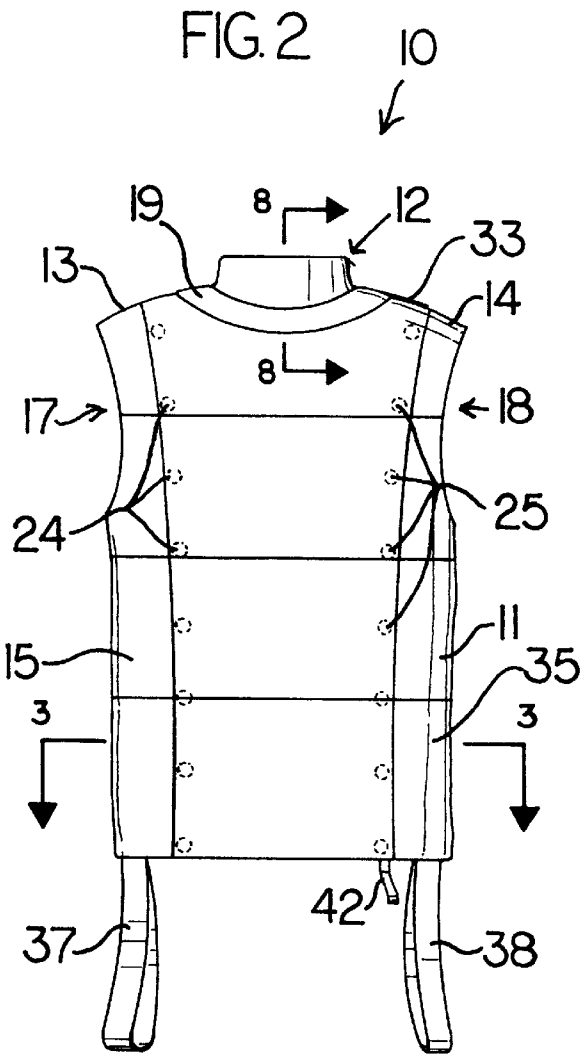
FIG. 2 is a front elevational view of the present invention when inflated.
Figure 1:
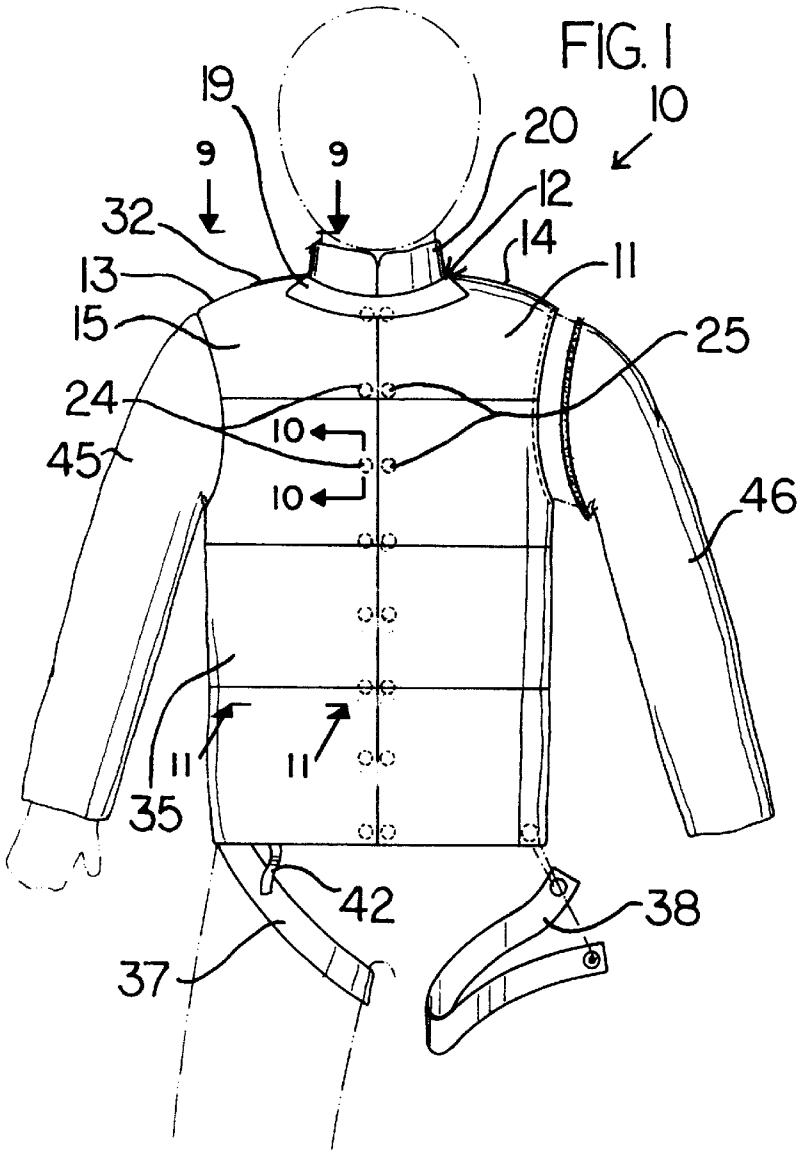
FIG. 1 is a front elevational view of a new survival article of clothing according to the present invention.
Figure 3:
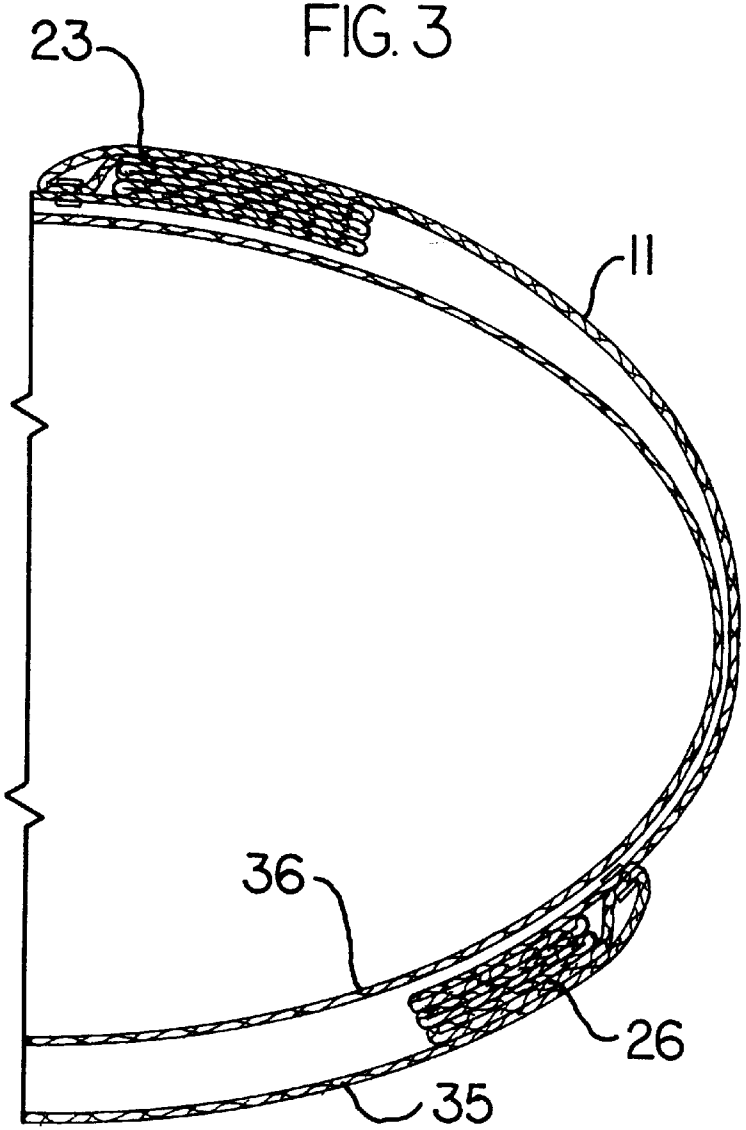
FIG. 3 is a top cross-sectional view of the jacket member of the present invention.
Figure 7:
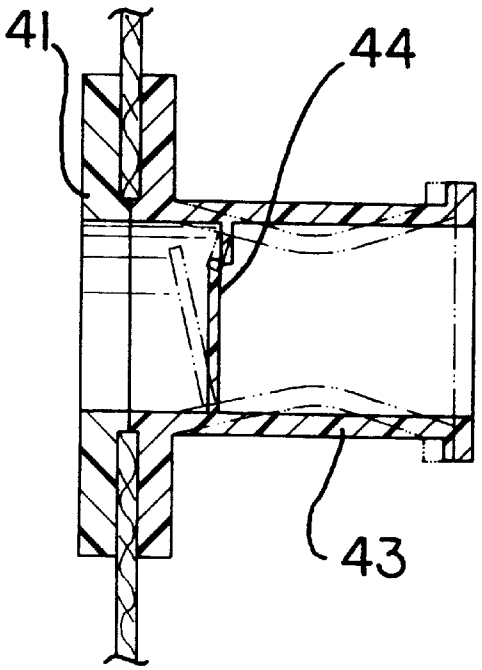
FIG. 7 is a cross-sectional view of the mouthpiece of the tubular member of the present invention.
Figure 5:
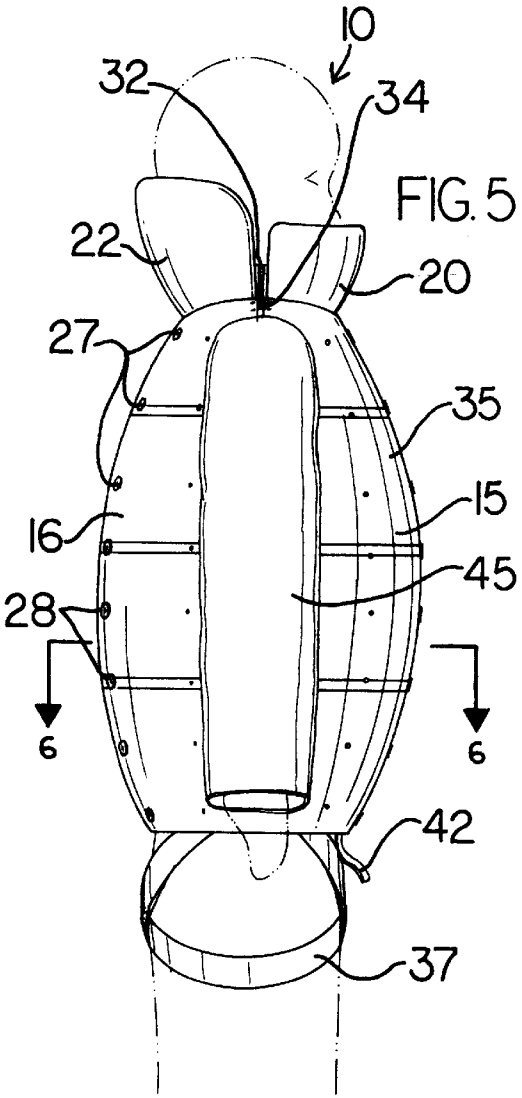
FIG. 5 is a side elevational view of the present invention shown in use.
Figure 4:
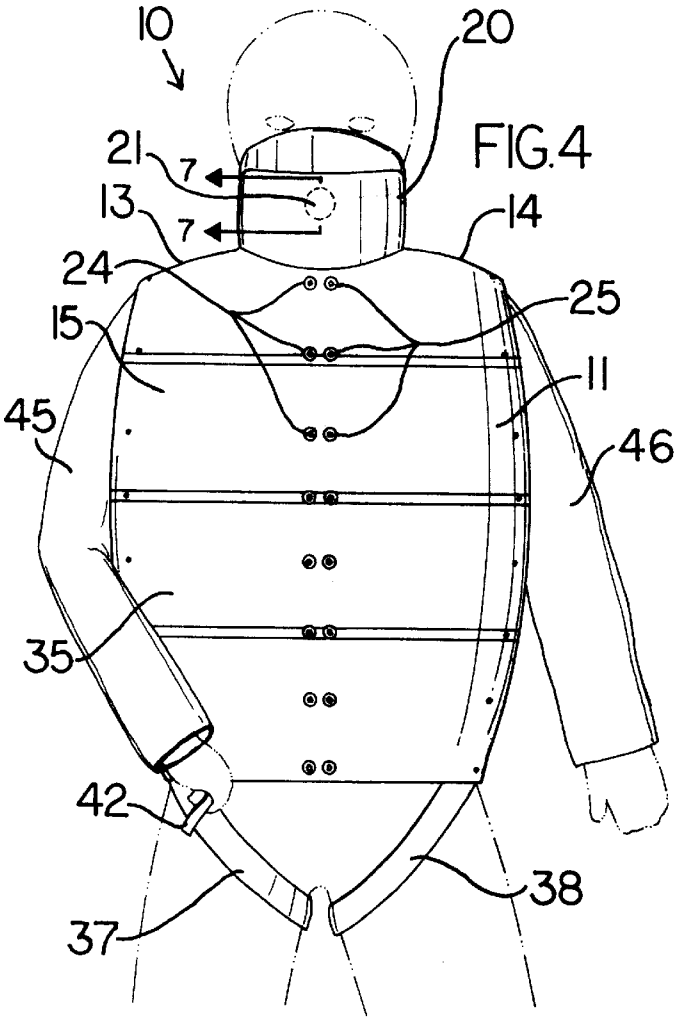
FIG. 4 is a front elevational view of the present invention shown in use.
Figure 10:
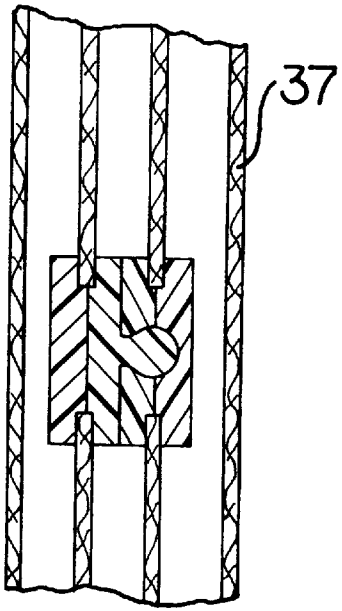
FIG. 10 is a cross-sectional view of one of the strap members of the present invention.
Figure 11:
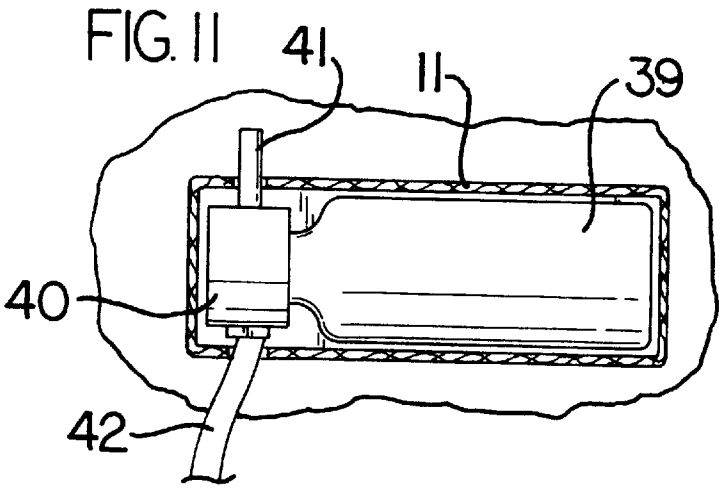
FIG. 11 is a side elevational view of the container, regulator, rip cord and tubular member of the present invention.
Figure 6:
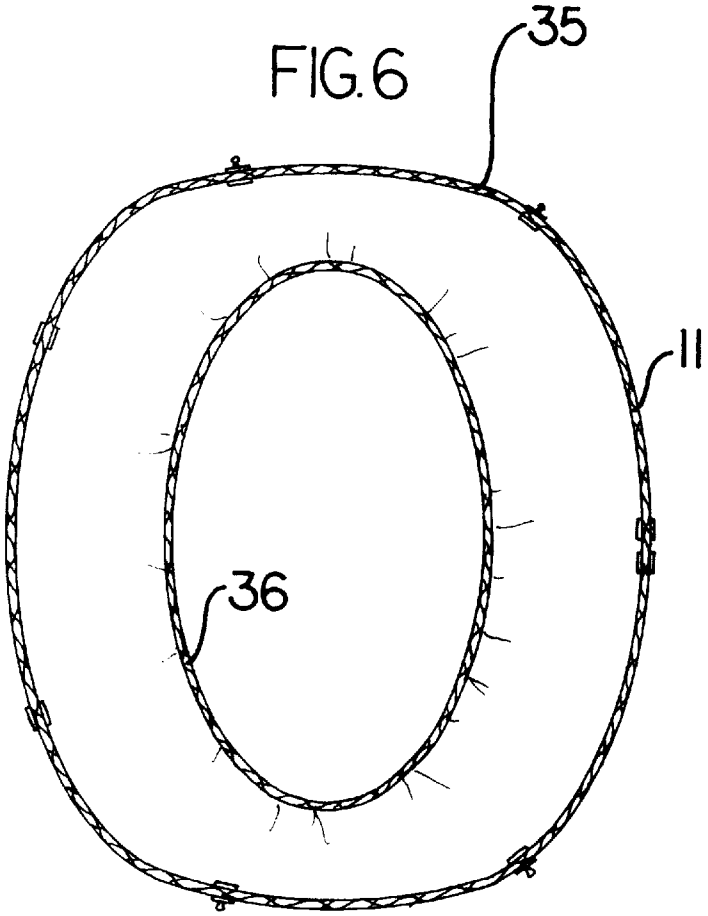
FIG. 6 is a top cross-sectional view of the jacket member of the present invention when inflated.
Figure 8:
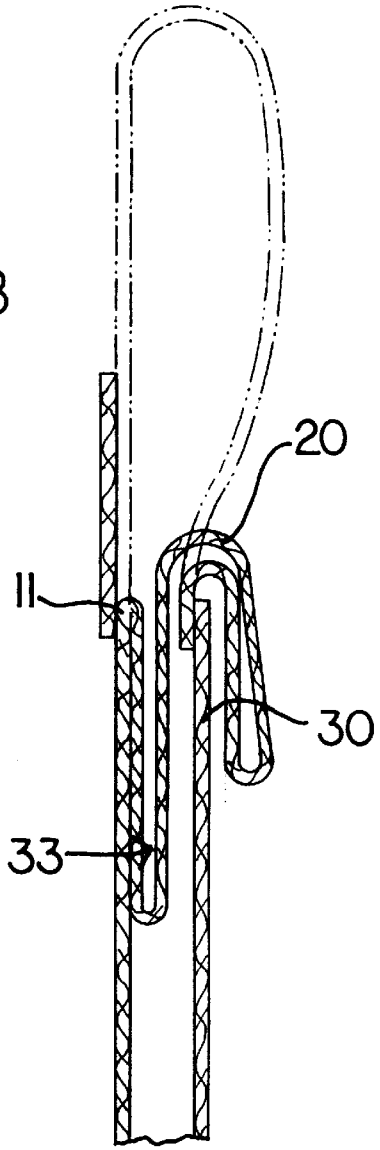
FIG. 8 is a cross-sectional view of the neck region of the jack member and the flap-like protection members of the present invention.
Figure 9:
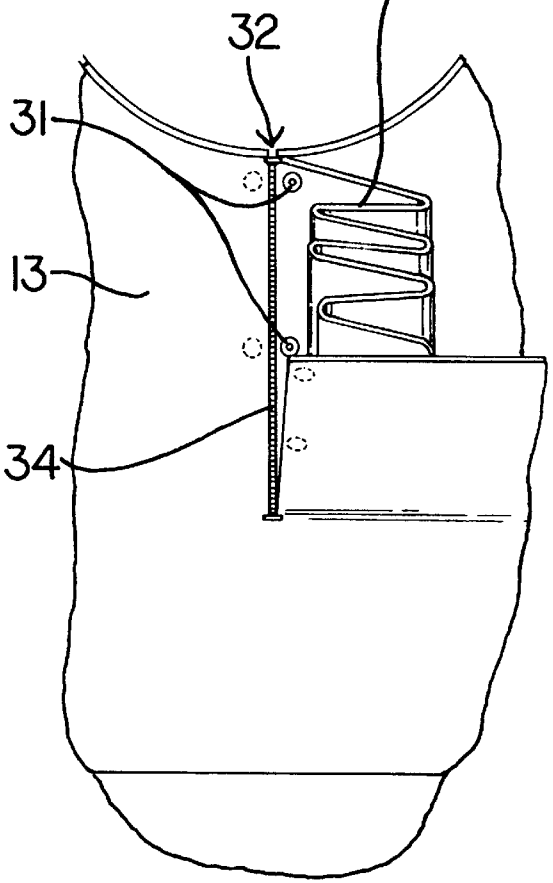
FIG. 9 is a top plan view of one of the shoulder portions of the jacket member of the present invention.

With reference now to the drawings, and in particular to FIGS. 1 through 11 thereof, a new survival article of clothing embodying the principles and concepts of the present invention and generally designated by the reference numeral 10 will be described.

As best illustrated in FIGS. 1 through 11, the survival article of clothing 10 generally comprises a sleeve-less inflatable jacket member 11 having a neck opening 12, shoulder portions 13,14, arm openings 17,18 through the shoulder portions 13,14 thereof, and being adapted to cover a front and a back of a user's upper torso. The jacket member 11 also has an expandable and inflatable outer layer of material 35 and an inner layer of material 36 and a collar member 19 securely and conventionally attached along the neck opening 12 for covering the user's neck region. The outer layer of material 35 includes first 23 and second 26 pleated portions extending along the front side 15 and the back side 16 of the jacket member 11. Each of the first 23 and second 26 pleated portions extends from the neck opening 12 to a bottom of the jacket member 11 along a central portion of a respective front and back sides 15,16 of the jacket member 11. The jacket member 11 includes a plurality of fasteners 24,25,27,28 securely and conventionally attached to the front and back sides 15,16 of the jacket member 11 along the first 23 and second 26 pleated portions of the outer layer of material 35 for preventing the pleated portions 23,26 from being uncontrollably unfolded. The fasteners 24,25,27,28 include a first 24 and second 25 row of fasteners on the front side 15 of the jacket member 11 and a third 27 and fourth 28 row of fasteners on the back side 16 of the jacket member 11. Each of the fasteners of the first row 24 is fastenable to a respective fastener of the second row 25, and each of the fasteners of the third row 27 is fastenable to a respective fastener of the fourth row 28. The outer layer of material 35 also includes a third 29 and fourth 30 pleated portion each extending from the neck opening 12 along a respective shoulder portion 13,14. Each of the pleated portions 23,26,29,30 includes multiple folds of the outer layer of material 35. The jacket member 11 further includes fastening members 31 extending along the shoulder portions 13,14 thereof for preventing the third and fourth pleated portions 29,30 from being uncontrollably unfolded. The jacket member 11 has a split 32,33 from and through the neck opening 12 and along the shoulder portions 13,14 adjacent to the third and fourth pleated portions 29,30. The jacket member 11 also includes zippers 34 extending along the splits 32,33 for opening and closing thereof.

Front and back foldable flap-like protective members 20,22 are securely and conventionally attached along the neck opening 12 of the jacket member 11 and are adapted to extend about the user's face below one's eyes and about a lower portion of the user's back of one's head. The front foldable flap-like protection member 20 includes a hole 21 therein with the hole 21 being adapted to be in alignment with the user's mouth upon the front foldable flap-like protection member 20 being extended about the user's face. Strap members 37,38 are fastenable to a bottom portion of the jacket member 11 and are extendable about the user's legs. Each of the strap members 37,38 is adapted to extend through the crotch region and about a respective thigh of the user. Sleeve members 45,46 are removably attached to and about the arm openings 17,18 of the jacket member 11.

Means for inflating the jacket member 11 and providing oxygen to the user includes a container 39 containing compressed air or oxygen and being securely and conventionally disposed in the jacket member 11, and also includes a regulator 40 conventionally connected to the container 39, and further includes a tubular member 41 conventionally connected to the regulator 40 and being extendable through the hole 21 of the front foldable flap-like protection member 20, and also includes a valve opening member 42 conventionally connected to the regulator 40 for releasing the compressed oxygen from the container 39. The tubular member 41 includes a mouthpiece 43 securely and conventionally attached at one end thereof and also includes a valve member 44 securely and conventionally disposed in the mouthpiece 43 for regulating flow of oxygen from the container 39. The container 39 is securely and conventionally disposed between the inflatable outer layer of material 35 and the inner layer of material 36 along the bottom portion of the jacket member 11 with the container 39 being essentially a cylinder and with the valve opening member 42 being essentially a rip cord which is disposed below the bottom portion of the jacket member 11.

In use, the user wears the survival article of clothing 10 and when needed for survival such as in an avalanche, the user inflates the jacket member 11 by pulling on the rip cord 42 which releases the compressed oxygen from the container 39. The user can breathe the oxygen through the tubular member 41 upon the front flap-like protection member 20 being extended about the face of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A survival article of clothing comprising:

a sleeve-less inflatable jacket member having a neck opening, shoulder portions, arm openings through said shoulder portions thereof, and being adapted to cover a front and a back of a user's upper torso, said jacket member also having an expandable outer layer of material and an inner layer of material and a collar member securely attached along said neck opening for covering the user's neck region front and back foldable flap-like protective members being securely attached along said neck opening of said jacket member and being adapted to extend about the user's face below one's eyes and about a lower portion of the user's back of one's head;

strap members being fastenable to a bottom portion of said jacket member and being extendable about the user's legs;

sleeve members being removably attached to and about said arm openings of said jacket member; and means for inflating said jacket member and providing oxygen to the user.

2. A survival article of clothing as described in claim 1, wherein said outer layer of material includes first and second pleated portions along said front side and said back side of said jacket member, each of said first and second pleated portions extending from said neck opening to a bottom of said jacket member along a central portion of a respective said front and back sides of said jacket member.

3. A survival article of clothing as described in claim 2, wherein said jacket member includes a plurality of fasteners securely attached to said front and back sides of said jacket member along said first and second pleated portions of said outer layer of material for preventing said pleated portions from being uncontrollably unfolded.

4. A survival article of clothing as described in claim 3, wherein said fasteners include a first and second row of fasteners on said front side of said jacket member and a third and fourth row of fasteners on said back side of said jacket member, each of said fasteners of said first row being fastenable to a respective said fastener of said second row, and each of said fasteners of said third row being fastenable to a respective said fastener of said fourth row.

5. A survival article of clothing as described in claim 4, wherein said outer layer of material also includes a third and fourth pleated portion each extending from said neck opening along a respective said shoulder portion.

6. A survival article of clothing as described in claim 5, wherein each of said pleated portions include multiple folds of said outer layer of material.

7. A survival article of clothing as described in claim 6, wherein said jacket member further includes fastening members extending along said shoulder portions thereof for preventing said third and fourth pleated portions from being uncontrollably unfolded.

8. A survival article of clothing as described in claim 7, wherein said jacket member has splits from and through said neck opening and along said shoulder portions adjacent to said third and fourth pleated portions.

9. A survival article of clothing as described in claim 8, wherein said jacket member also includes zippers extending along said splits for opening and closing thereof.

10. A survival article of clothing as described in claim 9, wherein said front foldable flap-like protection member includes a hole therein, said hole being adapted to be in alignment with the user's mouth upon said front foldable flap-like protection member being extended about the user's face.

11. A survival article of clothing as described in claim 10, wherein each of said strap members is adapted to extend through the crotch region and about a respective thigh of the user.

12. A survival article of clothing as described in claim 11, wherein said means for inflating said jacket member and providing oxygen to the user includes one or more containers containing compressed air or oxygen and being securely disposed in said jacket member, and also includes one or more regulators each being connected to a respective said container, and further includes a tubular member connected to said regulator and being extendable through said hole of one of said foldable flap-like protection members, and also includes one or more valve opening members each being connected to a respective said regulator for releasing the compressed oxygen from a respective said container.

13. A survival article of clothing as described in claim 12, wherein said tubular member includes a mouthpiece securely attached at one end thereof and also includes a valve member securely disposed in said mouthpiece for regulating flow of oxygen from each said container.

14. A survival article of clothing as described in claim 13, wherein each said container is securely disposed between said inflatable outer layer of material and said inner layer of material along said bottom portion of said jacket member.

15. A survival article of clothing as described in claim 14, wherein each said container is essentially a cylinder, and each said valve opening member is essentially a rip cord which is disposed below said bottom portion of said jacket member.

16. A survival article of clothing comprising:

a sleeve-less inflatable jacket member having a neck opening, shoulder portions, arm openings through said shoulder portions thereof, and being adapted to cover a front and a back of a user's upper torso, said jacket member also having an expandable outer layer of material and an inner layer of material and a collar member securely attached along said neck opening for covering the user's neck region, said outer layer of material including first and second pleated portions along said front side and said back side of said jacket member, each of said first and second pleated portions extending from said neck opening to a bottom of said jacket member along a central portion of a respective said front and back sides of said jacket member, said jacket member including a plurality of fasteners securely attached to said front and back sides of said jacket member along said first and second pleated portions of said outer layer of material for preventing said pleated portions from being uncontrollably unfolded, said fasteners including a first and second row of fasteners on said front side of said jacket member and a third and fourth row of fasteners on said back side of said jacket member, each of said fasteners of said first row being fastenable to a respective said fastener of said second row, and each of said fasteners of said third row being fastenable to a respective said fastener of said fourth row, said outer layer of material also including a third and fourth pleated portion each extending from said neck opening along a respective said shoulder portion, each of said pleated portions including multiple folds of said outer layer of material, said jacket member further including fastening members extending along said shoulder portions thereof for preventing said third and fourth pleated portions from being uncontrollably unfolded, said jacket member being split from and through said neck opening and along said shoulder portions adjacent to said third and fourth pleated portions, said jacket member also including zippers extending along said splits for opening and closing thereof;

front and back foldable flap-like protective members being securely attached along said neck opening of said jacket member and being adapted to extend about the user's face below one's eyes and about a lower portion of the user's back of one's head, said front foldable flap-like protection member including a hole therein, said hole being adapted to be in alignment with the user's mouth upon said front foldable flap-like protection member being extended about the user's face;

strap members being fastenable to a bottom portion of said jacket member and being extendable about the user's legs, each of said strap members being adapted to extend through the crotch region and about a respective thigh of the user;

sleeve members being removably attached to and about said arm openings of said jacket member; and means for inflating said jacket member and providing oxygen to the user including one or more containers each containing compressed air or oxygen and being securely disposed in said jacket member, and also including one or more regulators each connected to a respective said container, and further including a tubular member connected to each said regulator and being extendable through said hole of one of said foldable flap-like protection members, and also including one or more valve opening members each connected to a respective said regulator for releasing the compressed oxygen from a respective said container, said tubular member including a mouthpiece securely attached at one end thereof and also including a valve member securely disposed in said mouthpiece for regulating flow of oxygen from each said container, each said container being securely disposed between said inflatable outer layer of material and said inner layer of material along said bottom portion of said jacket member, each said container being essentially a cylinder, and each said valve opening member being essentially a rip cord which is disposed below said bottom portion of said jacket member.

* * * * *